US007193598B2

(12) United States Patent
Huang

(10) Patent No.: US 7,193,598 B2
(45) Date of Patent: Mar. 20, 2007

(54) NOISE SUPPRESSING METHOD FOR SWITCHING ON/OFF FLAT PANEL DISPLAY

(75) Inventor: Shih-Hsiung Huang, Taoyuan (TW)

(73) Assignee: Chunghwa Picture Tubes, Ltd., Taipei (TW)

( * ) Notice: Subject to any disclaimer, the term of this patent is extended or adjusted under 35 U.S.C. 154(b) by 465 days.

(21) Appl. No.: 10/604,248

(22) Filed: Jul. 4, 2003

(65) Prior Publication Data

US 2005/0001825 A1 Jan. 6, 2005

(51) Int. Cl.
*G09G 3/36* (2006.01)

(52) U.S. Cl. ..... 345/98; 345/204

(58) Field of Classification Search ..... 345/87–89, 345/98–100, 204–206, 211–213
See application file for complete search history.

(56) References Cited

U.S. PATENT DOCUMENTS 4,547,796 A * 10/1985 Iwase et al. ..... 348/642
4,873,574 A * 10/1989 Darby ..... 348/193
5,822,011 A * 10/1998 Rumreich ..... 348/549
5,926,602 A * 7/1999 Okura ..... 386/13
6,078,318 A * 6/2000 Mori et al. ..... 345/204
6,195,393 B1 * 2/2001 Nemiroff et al. ..... 375/240.28
6,459,849 B1 * 10/2002 Hasegawa ..... 386/109

FOREIGN PATENT DOCUMENTS

| | | |
|---|---|---|
| JP | 03-059598 | 5/1991 |
| JP | 03-202812 | 9/1991 |
| JP | 04-290388 | 10/1992 |
| JP | 06-130919 | 5/1994 |
| JP | 08-263020 | 10/1996 |

* cited by examiner

*Primary Examiner*—Regina Liang
(74) *Attorney, Agent, or Firm*—Jianq Chyun IP Office

(57) ABSTRACT

A noise suppressing method for switching on/off a flat panel display. A signal detect circuit and a video signal processor are embedded in a time controller IC. At the switch-on transient, the signal detect circuit functions to detect whether the signal is stable. When an unstable signal is detected, the video signal processor controls the driver IC to output a black burst signal. At the switch-off transient, the signal detect circuit is used to detect the switch-off signal. When the switch-off signal is detected, the video signal processor controls the driver IC to output a charge reset signal. The flat panel display is switched off after the charge reset operation is performed for all the pixels.

11 Claims, 8 Drawing Sheets

NOISE SUPPRESSING METHOD FOR SWITCHING ON/OFF FLAT PANEL DISPLAY

BACKGROUND OF INVENTION

1. Field of the Invention

The invention relates in general to a noise suppressing method for switching on/off a flat panel display, and more particularly, to a noise suppressing method that outputs a black burst signal from a driver IC at the switch-on transient, and outputs a charge reset signal from the driving chip at the switch-off transient.

2. Description of the Related Art

The fast development of multimedia is benefited by the progress of improvement in semiconductor devices or display apparatus. Having excellent display quality and being economic, the cathode ray tube has occupied the dominant position in the display market for years. However, problems involved with space utilization and power consumption remain unresolved for cathode ray tubes. The demands for being light, thin, short and small as well as low power consumption cannot be met with cathode ray tubes. Therefore, the thin-film transistor liquid crystal display (TFT-LCD) with high quality, effective space utilization, low power consumption, and non-radiation has gradually come to dominate the market and become main stream for display apparatus.

Currently, frame noise is caused by the unstable signal generated by switching on/off the flat panel display. The frame noise caused at the transient for switching on the flat panel display is generated by the unstable signal source. The frame noise caused at the transient for switching off the flat panel display is generated because signal termination process is not performed when the signal source is terminated, while the flat panel display is switched with the latest displayed frame. For example, in the thin-film transistor liquid crystal display, transient brightness appears on the displayed frame at the switch-on transient. In addition, if only the signal and the power source of the signal are switched off without switching off the backlight source at the switch-off transient, the image of the display frame is faded with a very slow speed. On the other hand, if the backlight source is switched off simultaneously with the signal and the power source of the signal, tidal variation of shadow appears in the display. Such phenomenon is referred as fade-out.

The conventional technique to resolve the fade-out phenomenon includes switching on all the pixels to make uniform the charges in each of the pixels. In this technique, all the pixels are switched on by the gate driver IC or row driver IC at the switch-off transient, so that the pixels can be quickly and uniformly discharged. However, when all the pixels are switched on by the gate driver chip to achieve the objective of making uniform the charges of the pixels controlled by the same data line, the charges of the pixels are made uniform along the whole display line in the vertical direction (that is, the display line controlled by the same data line).

In addition, at the switch-off transient, a large signal current has to be provided by the gate driver chip to switch on all the pixels. This is very likely to cause the concern of related circuit quality. In the example of a display with the resolution of 1024×768, the current of 1 mA has to be provided for switching on the thin-film transistor controlled by one scan line. By switching on the thin-film transistors controlled by 768 data lines at the same time, the required total current of 768 mA is very likely to damage the related circuit. Further, when the above charge uniformization is applied to a larger display panel with a higher resolution, the current for switching on all the pixels is further increased in accordance with the resolution. Therefore, the prior art technique for making uniform the charges of all the pixels to suppress the noise caused at the switch-off transient cannot be effectively applied to large panel.

SUMMARY OF INVENTION

The invention provides a noise suppression method for switching on/off a flat panel display applicable to large area flat panel display without causing the relative circuit quality issue.

The noise suppressing method provided by the present invention includes inserting a signal detect circuit and a video signal processor in a time controller IC. The signal detect circuit is used to detect whether the signal at the switch-on transient is stable. When an unstable signal is detected at the transient for switching on the display panel, a black burst signal is output by a driver IC controlled by the video signal processor. Therefore, the display screen is forced to display the black burst at the switch-on transient to avoid the noise caused by unstable signal. In addition, the black burst display time at the switch-on transient can be controlled by the frame time.

The present invention further provides a noise suppressing method for switching on/off a flat panel display. A signal detect circuit and a video signal processor are embedded in a time controller IC. The signal detect circuit is used to detect a switch-off signal. Being controlled by the video signal processor, the driver IC outputs a charge reset signal to each pixel of the display. The display is switched off after the charge reset is performed for each pixel, so that the fade-out phenomenon is improved.

The present invention further comprises a noise suppression method for switching on/off a flat panel display that integrates the noise suppression method at the switch-on transient and the switch-off transient as mentioned above. At the switch-on transient, the signal detect circuit in the time controller IC detects whether a signal is stable. When an unstable signal is detected at the switch-on transient, the video signal processor controls the driver IC to output a black burst signal. In addition, at the switch-off transient, the signal detect circuit of the time controller IC detects the switch-off signal. When the switch-off signal is detected, the video signal processor controls the controller IC to output a charge reset signal. When the charge reset operation is performed on all the pixels, the flat panel display is switched off. Thus, not only is the noise problem caused by the unstable signal generated at the switch-on transient resolved, but the fade-off phenomenon at the switch-off transient is also improved.

Both the foregoing general description and the following detailed description are exemplary and explanatory only and are not restrictive of the invention, as claimed.

DETAILED DESCRIPTION

Figure 1:
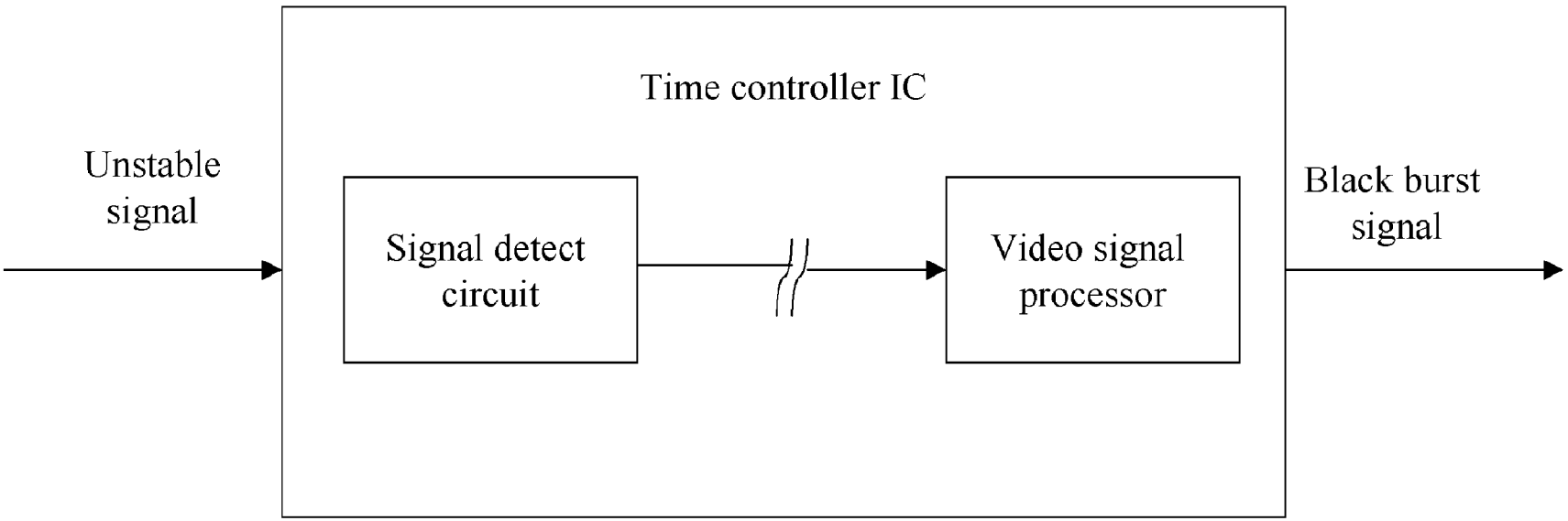
FIG. 1 is a schematic drawing of embedding a signal detect circuit and a video signal processor in a time controller IC to suppress switch-on noise according to one embodiment of the present invention.

In FIG. 1, a schematic drawing of using a signal detect circuit and a video signal processor of a time controller IC to suppress the switch-on/off noise in one embodiment of the present invention is shown. In the embodiment as shown in FIG. 1, a signal detect circuit and a video signal processor are embedded in the time controller IC of the flat panel display. When the flat panel display is switched on, the signal detect circuit is used to detect whether the signal at the switch-on transient is stable. When the signal detecting circuit detects an unstable signal, a black burst signal is output from a driver IC controlled by the video signal processor, such that the displayed screen is forced to display a black burst at the switch-on transient. Consequently, the noise caused by unstable signal is avoided.

The time for displaying the black burst at the switch-on transient is controlled by the corresponding time of a frame. For example, the corresponding time of a frame is about 15.7 ms for a flat panel display with a scanning frequency of about 60 Hz. Therefore, the displaying time of the black burst at the switch-on transient can last for about (15.7×N) ms. The time for displaying the black burst can be determined by the video signal processor, while the value of N is closely related to the lasting time of the unstable signal.

Figure 2:
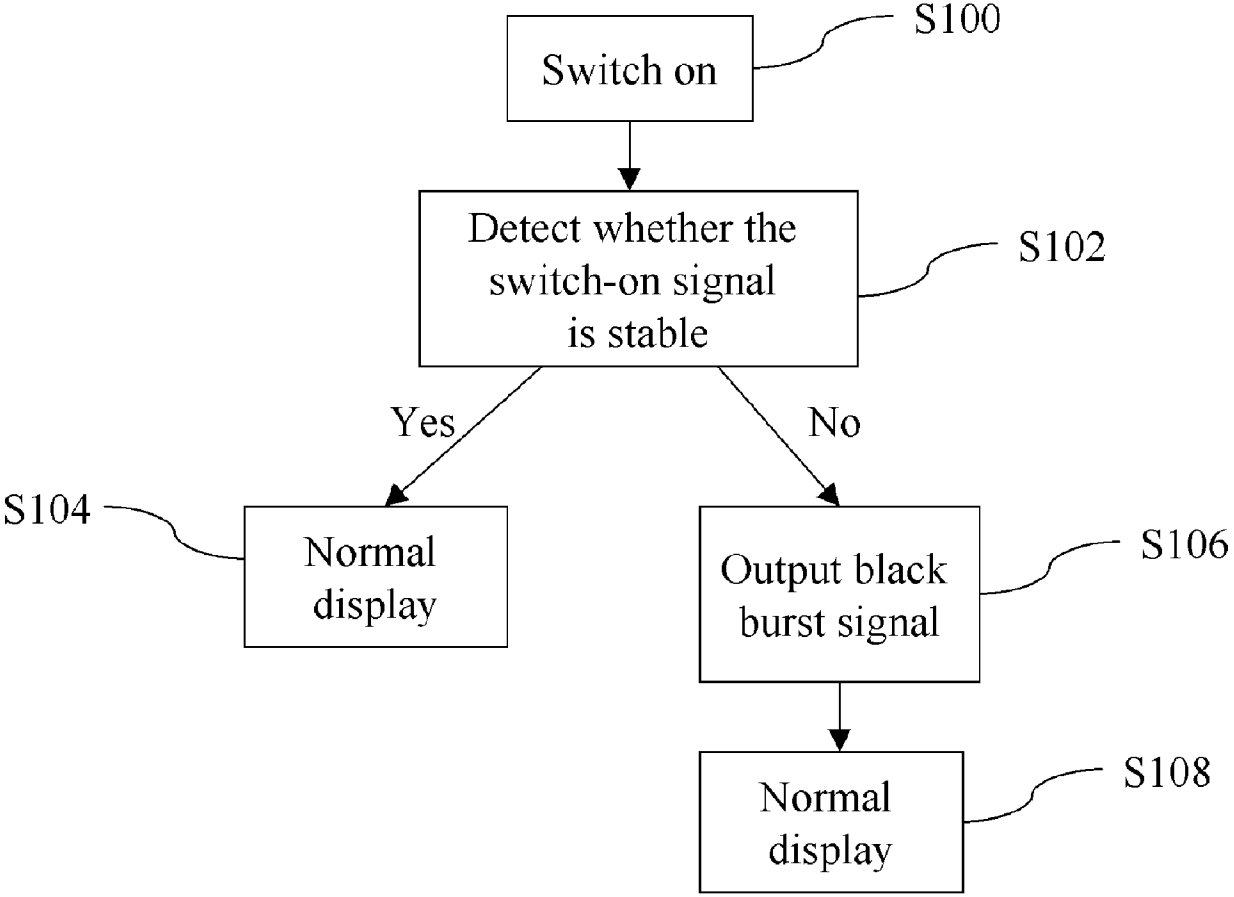
FIG. 2 is a block diagram showing the method of suppressing the switch-on noise of a flat panel display.

FIG. 2 shows a block diagram of suppressing switch-on noise for a flat panel display in one embodiment of the present invention. Referring to FIG. 2, at the switch-on transient (S100), the signal detect circuit of the time controller IC starts to detect whether a signal is stable (S102). According to the detecting result of the signal detect signal, the next process is determined. If the signal detected by the signal detect signal is stable, the video signal processor controls the driver IC to output a normal display signal allowing the panel to display normally (S104). On the other hand, when an unstable signal is detected by the signal detect circuit, the video signal processor of the time controller IC controls the driver chip to output a black burst signal (S106). After the signal detected by the signal detect circuit recovers to normal, the video signal processor outputs the normal display signal allowing the panel to display normally again (S108).

Figure 3A:
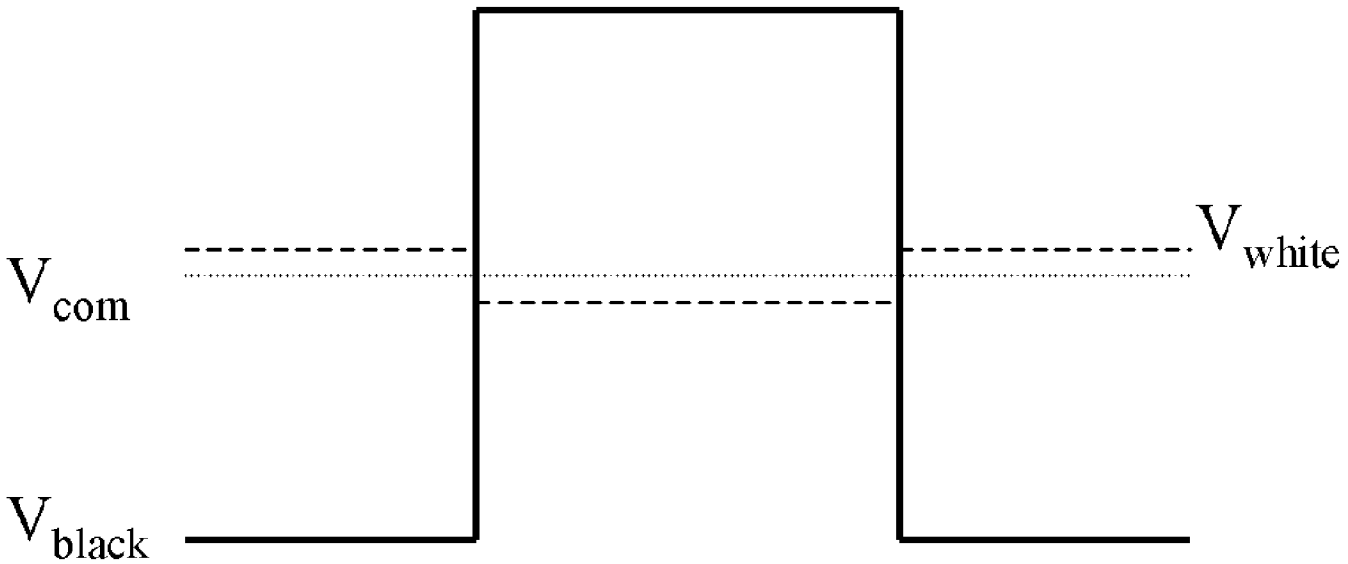
FIGS. 3A and 3B shows an embodiment in which the video signal processor outputs a signal at the switch-on transient.
Figure 3B:
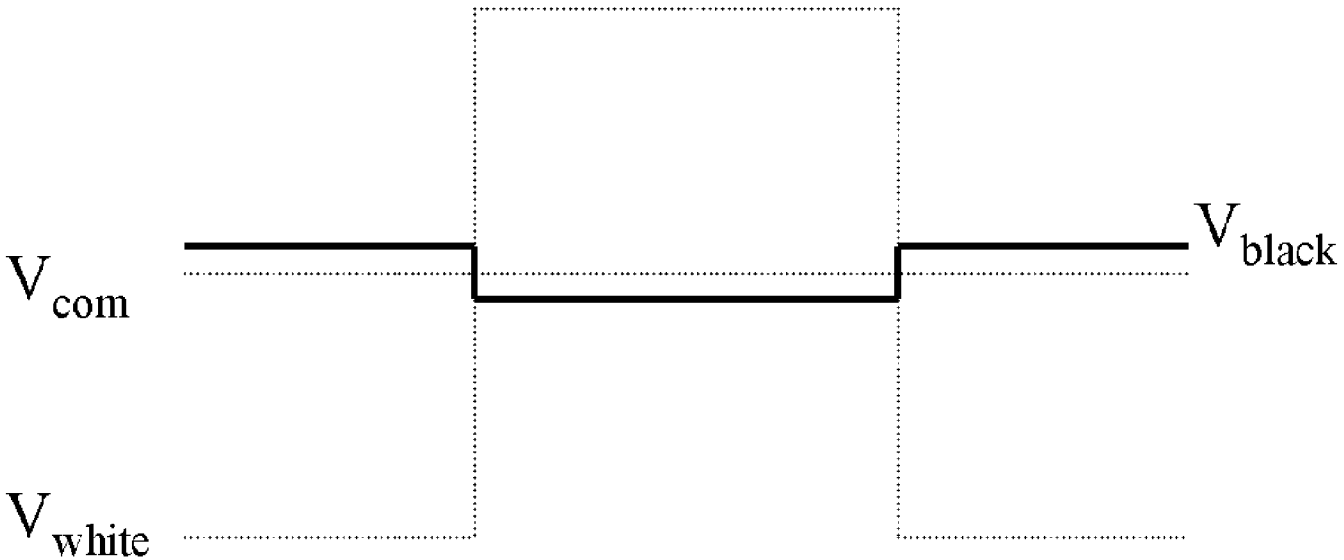

FIGS. 3A and 3B show the image output by the video signal processor at the switch-on transient in one embodiment of the present invention. In this embodiment, by outputting a black burst signal at the switch-on transient, the display screen is forced to display a black burst, so that the noise caused by an unstable signal is avoided. Typically, panels are classified into a normally white type and a normally black type. Referring to FIG. 3A, when a normally white type panel is driven, a voltage differential between the white signal $V_{white}$ and the common voltage $V_{common}$ applied to the panel is smaller than the voltage differential between the black signal $V_{black}$ and the common voltage $V_{common}$. Therefore, to suppress the switch-on noise of a normally white panel, the video signal processor controls the driver IC to output the black signal $V_{black}$ with a larger voltage differential from the common voltage $V_{common}$, such that the normally white panel displays a black burst at the switch-on transient.

Referring to FIG. 3B, while driving a normally black panel, the voltage differential between the white signal $V_{white}$ applied to the panel and the common voltage $V_{common}$ is larger than that between the black signal $V_{black}$ and the common voltage $V_{common}$. Therefore, to suppress the switch-on noise of a normally black panel, the black signal $V_{black}$ with a smaller voltage differential from the common voltage $V_{common}$ is output allowing the normally black panel to display black burst at the switch-on transient.

Figure 4:
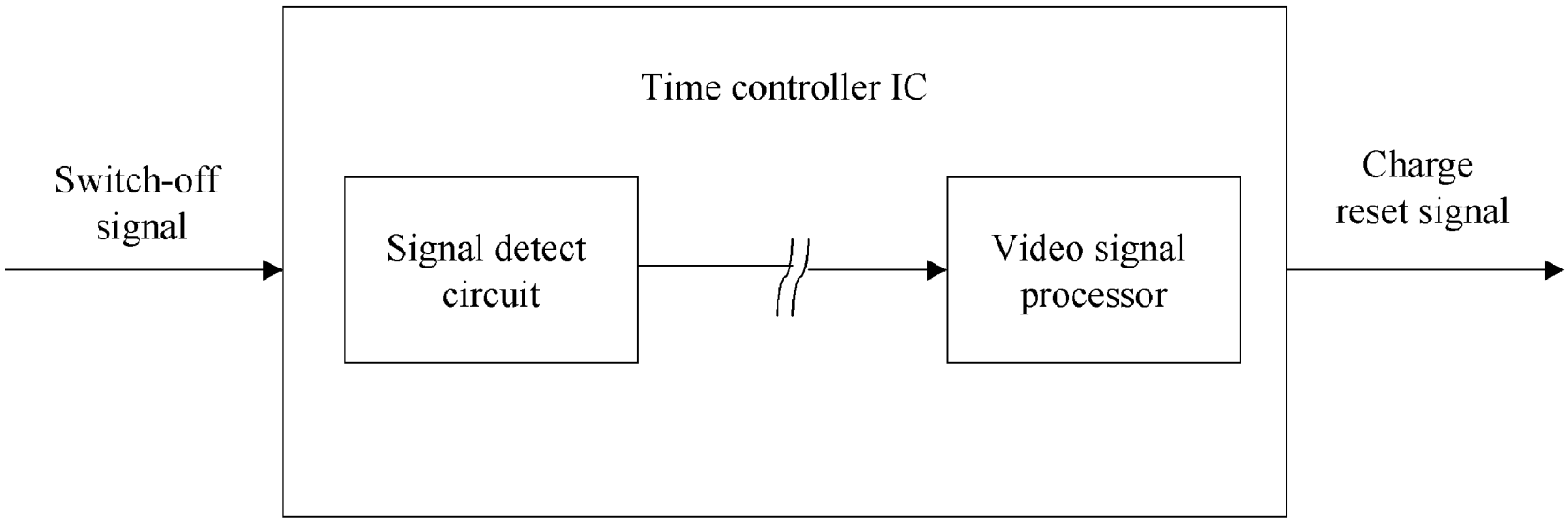
FIG. 4 shows a schematic drawing of using a time controller IC to suppress the switch-off noise.

FIG. 4 shows the schematic drawing of suppressing the switch-off noise using the time controller IC according to one embodiment of the present invention. In this embodiment, the time controller IC comprises a signal detect circuit and a video signal processor. At the transient of switching off the panel, the signal detect circuit detects the switch-off signal. The video signal processor then controls the driver IC to output a charge reset signal to each of the pixels of the display. After the charge reset operation is performed on each of the pixels, the panel is switched off to improve the fade-out phenomenon.

Figure 5:
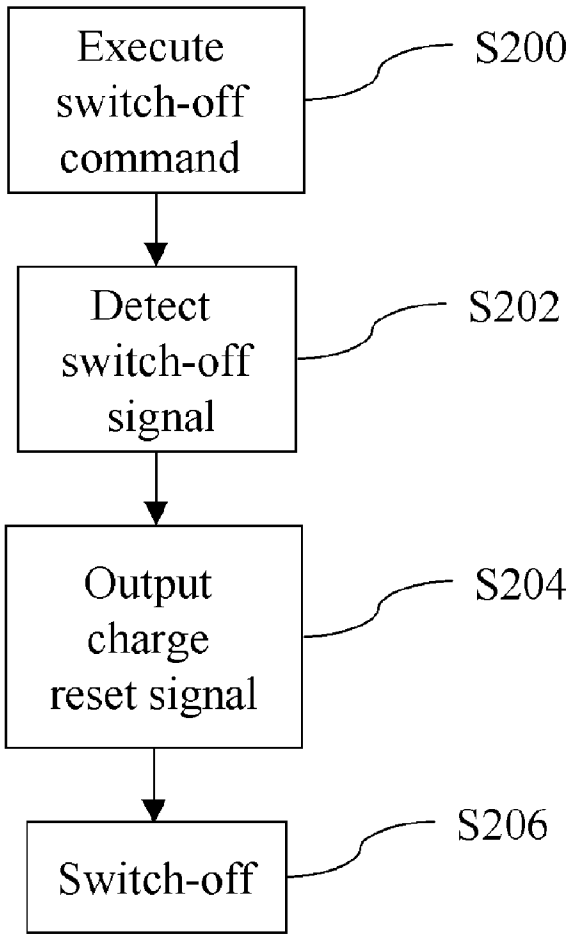
FIG. 5 shows a block diagram of the switch-off noise suppressing method of a flat panel.

FIG. 5 shows a block diagram of the noise suppressing method for switching off a flat panel display in one embodiment of the present invention. Referring to FIG. 5, when the switch-off command is executed by the user (S200), the signal detect circuit of the time controller IC detects a switch-off signal (S202). When the switch-off signal is detected by the signal detect circuit, the video signal processor of the time controller IC controls the driver IC to output a charge reset signal (S204) allowing all the pixels of the flat panel display to perform charge reset. After all the pixels have performed charge reset, the flat panel display is switched off (S206).

Figure 6A:
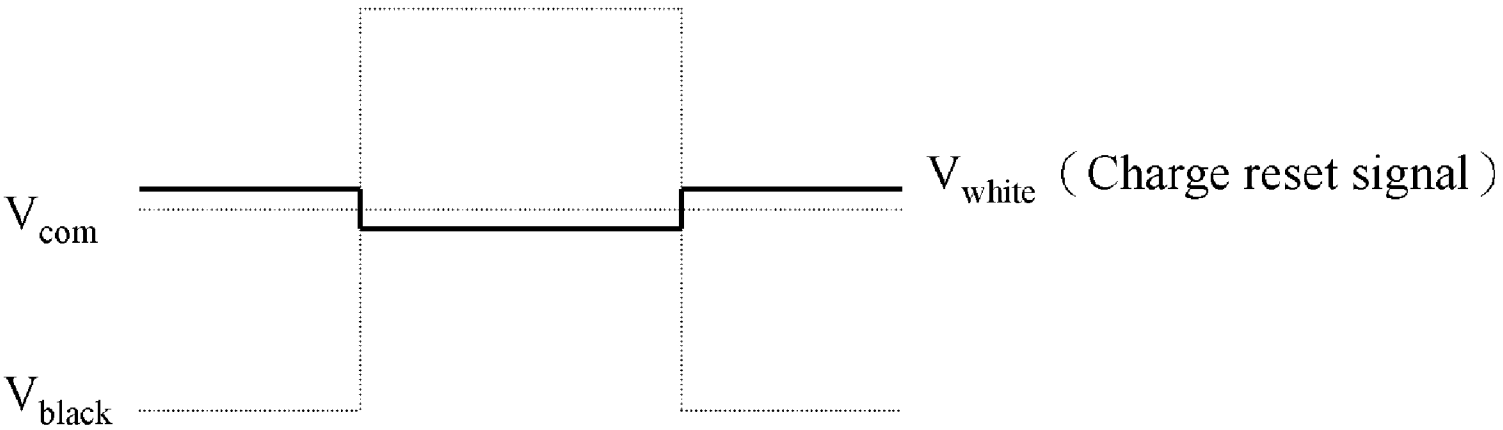
FIGS. 6A and 6B show schematic drawings of outputting a signal at the switch-off transient by the video signal processor.
Figure 6B:
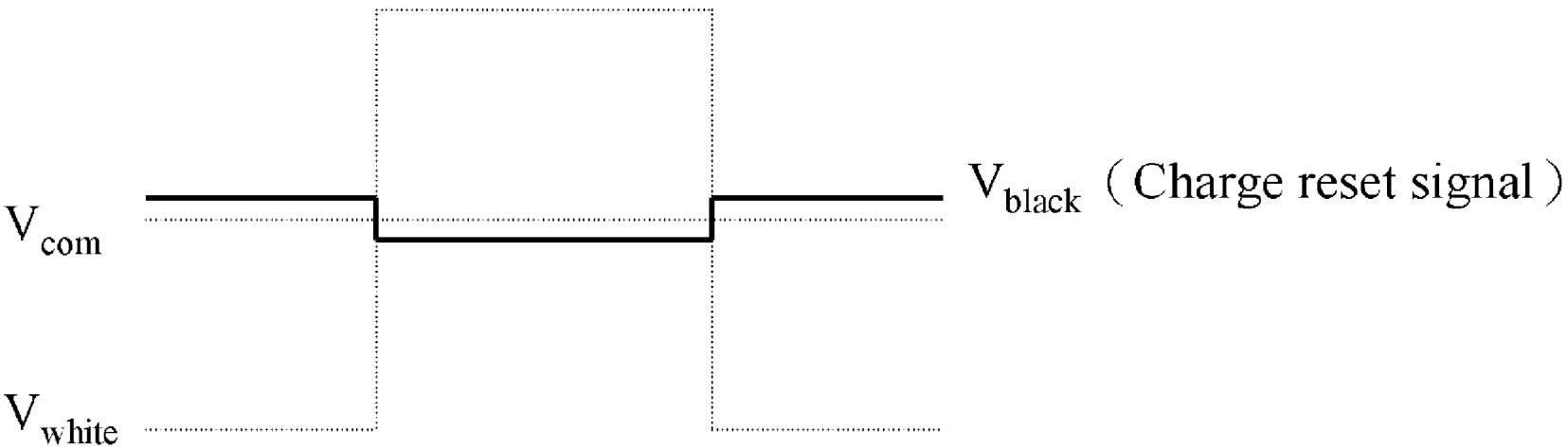

FIGS. 6A and 6B show the signal output at the switch-off transient by the video signal processor. Referring to FIG. 6A, while driving a normally white panel, the voltage differential between the white signal $V_{white}$ applied to the panel and the common voltage $V_{common}$ is smaller than the voltage differential between the black signal $V_{black}$ and the common voltage $V_{common}$. Therefore, to suppress the noise for switching off the normally white panel, the video signal processor controls the driver IC to output the white signal $V_{white}$ which is the charge reset signal. Therefore, all the pixels can perform charge reset before the normally white panel is switched off.

Referring to FIG. 6B, while driving the normally black panel, the voltage differential between the white signal $V_{white}$ applied to the panel and the common voltage $V_{common}$ is larger than the voltage differential between the black signal $V_{black}$ and the common voltage $V_{common}$. Therefore, to suppress the noise for switching off the normally black panel, the video signal processor controls the driver IC to output the black signal $V_{black}$, which is the charge reset signal. Therefore, all the pixels can perform charge reset before the normally white panel is switched off.

In the above embodiments, the noise suppressing methods for switching on and off the flat panel display have been described. It is appreciated that people skilled in the art may integrate both noise suppression methods to avoid the noise at transients of switching on and switching off the flat panel display. At the switching on transient, the signal detect circuit of the time controller IC detects whether the signal is stable. When an unstable signal is detected thereby, the video signal processor controls the driver IC to output a black burst signal. At the switch-off transient, the signal detect circuit detects a switch-off signal. When the switch-off signal is detected, the video signal processor controls driver IC to output the charge reset signal. Therefore, the flat panel display is not switched off until all the pixels thereof have performed charge reset. The noise caused by the unstable signal generated at the switch-on transient is suppressed, and the fade-out phenomenon caused at the switch-off transient is also improved.

Accordingly, the noise suppressing method for switching on/off the flat panel display provided by the present invention has at least the following advantages: 1. While switching on the flat panel display, the black burst is forced to be output to effectively suppress the generation of switch-on noise. 2. While switching off the flat panel display, the charge reset signal is output. The flat panel display is not switched off until all the charge reset operations are performed on all the pixels to effectively suppress the switch-off noise. 3. The noise suppressing method for switching on/off the flat panel display provided by the present invention does not only resolve the noise problems caused by the unstable signal generated at the switch-on transient, but also improves the fade-out phenomenon.

Other embodiments of the invention will appear to those skilled in the art from consideration of the specification and practice of the invention disclosed herein. It is intended that the specification and examples are to be considered as exemplary only, with a true scope and spirit of the invention being indicated by the following claims.

The invention claimed is:

1. A noise suppressing method for a flat panel display driven by a time controller and a plurality of driver IC's, the noise suppressing method comprising:

providing a signal detect circuit and a video signal processor; and detecting whether a signal input to the flat panel display is stable by the signal detect circuit when the flat panel display is switched-on, and when the signal is unstable, controlling the driver IC's to output a black burst signal by the video signal processors, wherein when the flat panel display is driven with a normally white type, a voltage differential between a white signal $V_{white}$ and a common voltage $V_{common}$ applied to the flat panel display is smaller than a voltage differential between a black signal $V_{black}$ and the common voltage $V_{common}$, such that the video signal processor controls the driver IC to output the black signal $V_{black}$ with a larger voltage differential from the common voltage $V_{common}$ so as to display a black burst when the flat panel display is switched-on.

2. The noise suppressing method according to claim 1, further comprising embedding the signal detect signal in the time controller IC.

3. The noise suppressing method according to claim 1, further comprising embedding the video signal processor in the time controller IC.

4. The noise suppressing method according to claim 1, wherein the video signal processor controls the driver IC's to output a normal display signal when the signal detected by the signal detect circuit is stable.

5. The noise suppressing method according to claim 1, further comprising:

controlling the driver IC's to output a charge reset signal by the video signal processor when a switch-off signal is detected by the signal detect circuit while switching off the flat panel display, and switching off the flat panel display after charge reset operation is performed.

6. The noise suppressing method according to claim 5, further comprising embedding the signal detect signal in the time controller IC.

7. The noise suppressing method according to claim 5, further comprising embedding the video signal processor in the time controller IC.

8. The noise suppressing method according to claim 5, further comprising controlling the driver IC's to output a normal display signal by the video signal processor when the signal detected by the signal detect circuit is stable.

9. The noise suppressing method according to claim 5, wherein when the flat panel display is driven with a normally white type, a voltage differential between a white signal $V_{white}$ and a common voltage $V_{common}$ applied to the flat panel display is smaller than a voltage differential between a black signal $V_{block}$ and the common voltage $V_{common}$, such that the video signal processor controls the driver IC to output the white signal $V_{white}$ which is the charge reset signal, and thus the flat panel display can perform charge reset before the fiat panel display is switched off.

10. The noise suppressing method according to claim 5, wherein when the flat panel display is driven with a normally black type, a voltage differential between a white signal $V_{white}$ and a common voltage $V_{common}$ applied to the flat panel display is larger than a voltage differential between a black signal $V_{black}$ and the common voltage $V_{common}$, such that the video signal processor controls the driver IC to output the black signal $V_{black}$ which is the charge reset signal, and thus the flat panel display can perform charge reset before the flat panel display is switched off.

11. The noise suppressing method according to claim 1, wherein when the flat panel display is driven with a normally black type, a voltage differential between a white signal $V_{white}$ and a common voltage $V_{common}$ applied to the flat panel display is larger than a voltage differential between a black signal $V_{black}$ and the common voltage $V_{common}$, such that the video signal processor controls the driver IC to output the black signal $V_{black}$ with a smaller voltage differential from the common voltage $V_{common}$ so as to display a black burst when the flat panel display is switched-on.

* * * * *